US012644655B2

(12) United States Patent
Disori et al.

(10) Patent No.: US 12,644,655 B2
(45) Date of Patent: Jun. 2, 2026

(54) SECONDARILY APPLIED COLD SIDE FEATURES FOR CAST HEAT EXCHANGER

(71) Applicant: United Technologies Corporation, Farmington, CT (US)

(72) Inventors: Michael A. Disori, Glastonbury, CT (US); Dave J. Hyland, Portland, CT (US); Jeremy Styborski, East Hartford, CT (US); Adam J. Diener, Marlborough, CT (US); Alexander Broulidakis, Tolland, CT (US)

(73) Assignee: RTX CORORATION, Farmington, CT (US)

( * ) Notice: Subject to any disclaimer, the term of this patent is extended or adjusted under 35 U.S.C. 154(b) by 1333 days.

(21) Appl. No.: 16/278,259

(22) Filed: Feb. 18, 2019

(65) Prior Publication Data

US 2019/0310031 A1 Oct. 10, 2019

Related U.S. Application Data

(60) Provisional application No. 62/653,103, filed on Apr. 5, 2018.

(51) Int. Cl.
*F28F 3/08* (2006.01)
*F28F 1/02* (2006.01)
(Continued)

(52) U.S. Cl.
CPC ..... *F28F 3/08* (2013.01); *F28F 1/022* (2013.01); *F28F 1/30* (2013.01); *F28F 3/027* (2013.01); *F28F 3/06* (2013.01); *F28F 2215/00* (2013.01)

(58) Field of Classification Search
CPC ..... F28F 1/00; F28F 1/02; F28F 1/022; F28F 1/10; F28F 1/12; F28F 1/14; F28F 1/26;
(Continued)

(56) References Cited

U.S. PATENT DOCUMENTS 2,183,956 A * 12/1939 Campbell ..... F28D 9/0081 165/145
4,516,632 A * 5/1985 Swift ..... F28D 9/0075 165/166
(Continued)

FOREIGN PATENT DOCUMENTS

EP 2966391 1/2016
EP 3279598 A1 2/2018
(Continued)

OTHER PUBLICATIONS

Machine Translation JPS60238684 (Year: 1985).*
(Continued)

*Primary Examiner* — Jenna M Maroney
*Assistant Examiner* — Gustavo A Hincapie Serna
(74) *Attorney, Agent, or Firm* — Carlson, Gaskey & Olds, P.C.

(57) ABSTRACT

A heat exchanger includes a primary plate including a first surface, a second surface, a leading edge, a trailing edge and a plurality of internal passages extending between an inlet and an outlet. A secondary plate is attached to at least one of the first surface and second surface of the primary plate. The secondary plate includes heat transfer structures. A method is also disclosed.

2 Claims, 7 Drawing Sheets

(51) Int. Cl.
*F28F 1/30* (2006.01)
*F28F 3/02* (2006.01)
*F28F 3/06* (2006.01)

(58) Field of Classification Search
CPC ..... F28F 1/30; F28F 3/00; F28F 3/02; F28F 3/027; F28F 3/06; F28F 3/08; F28F 2215/00; F28F 9/02; F28D 1/053
USPC ..... 165/148
See application file for complete search history.

(56) References Cited

U.S. PATENT DOCUMENTS 4,729,428 A * 3/1988 Yasutake ..... F28D 9/0062 165/153
5,519,946 A * 5/1996 Renzi ..... F26B 5/06 34/239
7,343,965 B2 3/2008 Memory et al.
8,033,326 B2 10/2011 Dakhoul
2002/0050347 A1* 5/2002 Hainley ..... F28D 9/005 165/167
2004/0261986 A1 12/2004 Insalaco
2010/0326644 A1 12/2010 Hung et al.
2011/0011570 A1* 1/2011 Levings ..... F28F 9/18 165/166
2011/0132570 A1* 6/2011 Wilmot ..... F28F 19/006 165/41
2013/0153189 A1 6/2013 Lin et al.
2013/0191079 A1* 7/2013 Berukhim ..... F28F 9/028 703/1
2018/0112923 A1* 4/2018 Liu ..... F28F 1/128
2020/0072561 A1* 3/2020 Eijima ..... F28F 9/0075

FOREIGN PATENT DOCUMENTS

JP S60238684 A * 11/1985
WO 01/81849 A1 11/2001

OTHER PUBLICATIONS

JPS60238684A Machine Translation (Year: 1985).*
Machine Translation JPS60238684A (Year: 1985).*
European Search Report for EP Application No. 19167398.7 dated Sep. 13, 2019.

* cited by examiner

SECONDARILY APPLIED COLD SIDE FEATURES FOR CAST HEAT EXCHANGER

CROSS-REFERENCE TO RELATED APPLICATION

This application claims priority to U.S. Provisional Application No. 62/653,103 filed on Apr. 5, 2018.

BACKGROUND

A plate fin heat exchanger includes adjacent flow paths that transfer heat from a hot flow to a cooling flow. The flow paths are defined by a combination of plates and fins that are arranged to transfer heat from one flow to another flow. The plates and fins are created from sheet metal material brazed together to define the different flow paths. Thermal gradients present in the sheet material create stresses that can be very high in certain locations. The stresses are typically largest in one corner where the hot side flow first meets the coldest portion of the cooling flow. In an opposite corner where the coldest hot side flow meets the hottest cold side flow the temperature difference is much less resulting in unbalanced stresses across the heat exchanger structure. Increasing temperatures and pressures can result in stresses on the structure that can exceed material and assembly capabilities.

Turbine engine manufactures utilize heat exchangers throughout the engine to cool and condition airflow for cooling and other operational needs. Improvements to turbine engines have enabled increases in operational temperatures and pressures. The increases in temperatures and pressures improve engine efficiency but also increase demands on all engine components including heat exchangers.

Turbine engine manufacturers continue to seek further improvements to engine performance including improvements to thermal, transfer and propulsive efficiencies.

SUMMARY

In a featured embodiment, a heat exchanger includes a primary plate including a first surface, a second surface, a leading edge, a trailing edge and a plurality of internal passages extending between an inlet and an outlet. A secondary plate is attached to at least one of the first surface and second surface of the primary plate. The secondary plate includes heat transfer structures.

In another embodiment according to the previous embodiment, the heat transfer structures of the secondary plate includes a plurality of fin portions.

In another embodiment according to any of the previous embodiments, the heat transfer features of the secondary plate includes augmentation structures.

In another embodiment according to any of the previous embodiments, the fin portions includes rows extending between the leading edge and trailing edge and a channel bottom between the rows. The augmentation structures are disposed on the channel bottom.

In another embodiment according to any of the previous embodiments, the augmentation structures are further disposed at least some of the plurality of fin portions.

In another embodiment according to any of the previous embodiments, the augmentation structures extend from the channel bottom up a side of at least one of the plurality of fin portions bordering the channel bottom.

In another embodiment according to any of the previous embodiments, the augmentation structures include trip strips that alternate between extending up one of the plurality of fin portions on one side of the bottom channel and extending up another of the plurality of fin portion on another side of the bottom channel.

In another embodiment according to any of the previous embodiments, the augmentation structure includes one of a continuous uninterrupted wall, an interrupted wall, a pedestal, a dimple and a groove.

In another embodiment according to any of the previous embodiments, the primary plate and the secondary plate include a common material.

In another embodiment according to any of the previous embodiments, the primary plate and the secondary plate are formed from different materials.

In another embodiment according to any of the previous embodiments, a joint between the secondary plate and the primary plate is included. The joint including one of a brazed joint, a transient liquid phase joint and a diffusion bonded joint.

In another embodiment according to any of the previous embodiments, a plurality of primary plates are formed as a single unitary structure and a plurality of secondary plates are attached to at least one of the first surface and second surface of each of the plurality of primary plates.

In another embodiment according to any of the previous embodiments, spaces are disposed between the plurality of primary plates and at least one secondary plate is disposed within each of the spaces.

In another featured embodiment, a heat exchanger includes a primary plate including a first surface, a second surface, a leading edge, a trailing edge and a plurality of internal passages extending between an inlet and an outlet. A secondary plate is attached to at least one of the first surface and second surface of the primary plate. The secondary plate includes means for transferring heat.

In another embodiment according to the previous embodiment, the means for transferring heat of the secondary plate includes a plurality of fin portions.

In another embodiment according to any of the previous embodiments, the fin portions include rows extending between the leading edge and trailing edge and a channel bottom between the rows. A means for thermal transfer is disposed on the channel bottom.

In another embodiment according to any of the previous embodiments, the means for thermal transfer is further disposed on at least some of the plurality of fin portions.

In another embodiment according to any of the previous embodiments, a joint is between the secondary plate and the primary plate. The joint includes one of a brazed joint, a transient liquid phase joint and a diffusion bonded joint.

In another featured embodiment a method of assembling a heat exchanger includes casting a primary plate including a first surface, second surface, a leading edge, a trailing edge and a plurality of internal passages extending between an inlet and an outlet At least one secondary plate is formed including heat transfer structures. The secondary plate is attached to at least one of the first surface and second surface of the primary plate.

In another embodiment according to the previous embodiment, the heat transfer structures include at least one of a plurality of fin portions and augmentation structures.

In another embodiment according to any of the previous embodiments, the secondary plate is formed to include a bottom channel between fin portions and the augmentation structures are formed to extend from the channel bottom up a side of at least one of the plurality of fin portions bordering the channel bottom.

In another embodiment according to any of the previous embodiments, the primary plate and the secondary plate are formed from a common material.

In another embodiment according to any of the previous embodiments, the primary plate and the secondary plate are formed from different materials.

In another embodiment according to any of the previous embodiments, a joint is formed between the secondary plate and the primary plate. The joint including one of a brazed joint, a transient liquid phase joint and a diffusion bonded joint.

In another embodiment according to any of the previous embodiments, a plurality of primary plates formed as a single unitary structure and a plurality of secondary plates for attachment are formed to at least one of the first surface and second surface of each of the plurality of primary plates.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
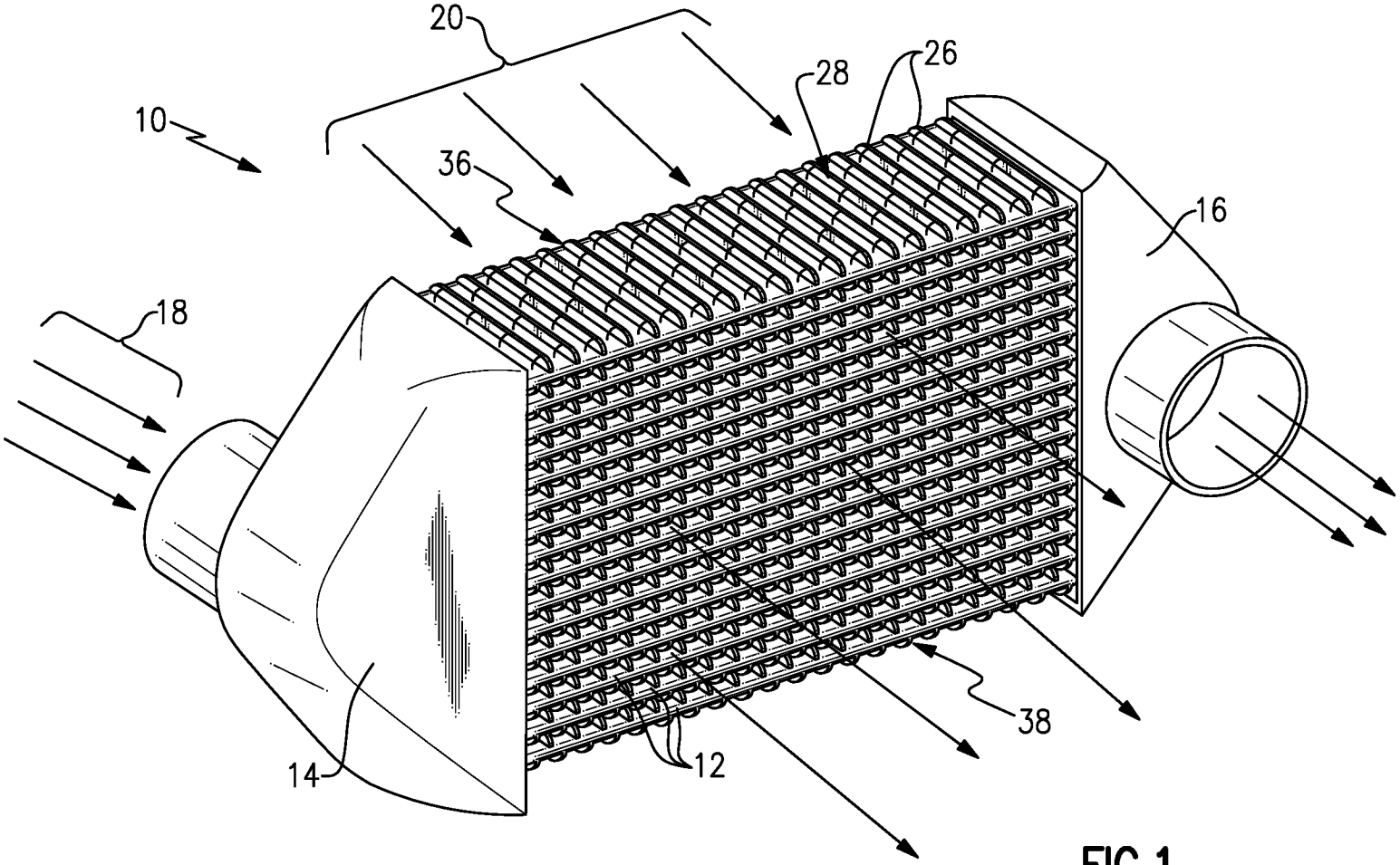
FIG. 1 is a perspective view of an example heat exchanger.

Referring to FIG. 1, an example heat exchanger 10 includes a plurality of plate assemblies 12 disposed between an inlet manifold 14 and an outlet manifold 16. A hot flow 18 enters the inlet manifold 14 and flows through passages defined within the plate assemblies 12. A cooling air flow 20 flows over and through spaces between the plate assemblies 12. In the example heat exchanger 10, a plurality of plate assemblies 12 are disposed between the inlet manifold 14 and the outlet manifold 16. Each of the plate assemblies 12 include a plurality of fin portions 26 and augmentation structures 28 disposed between the fin portions 26. The fin portions 26 extend from a leading edge 36 to a trailing edge 38. The cooling air flow flows over and through the fins 26 beginning at the leading edge 36 and ending at the trailing edge 38.

It should be appreciated that although an example heat exchanger 10 is show by way of example, other configurations of a heat exchanger are within the contemplation of this disclosure. For example, the plate assemblies 12 may be mated to other inlet and outlet structures different than the disclosed example inlet and outlet manifolds.

Figure 2:
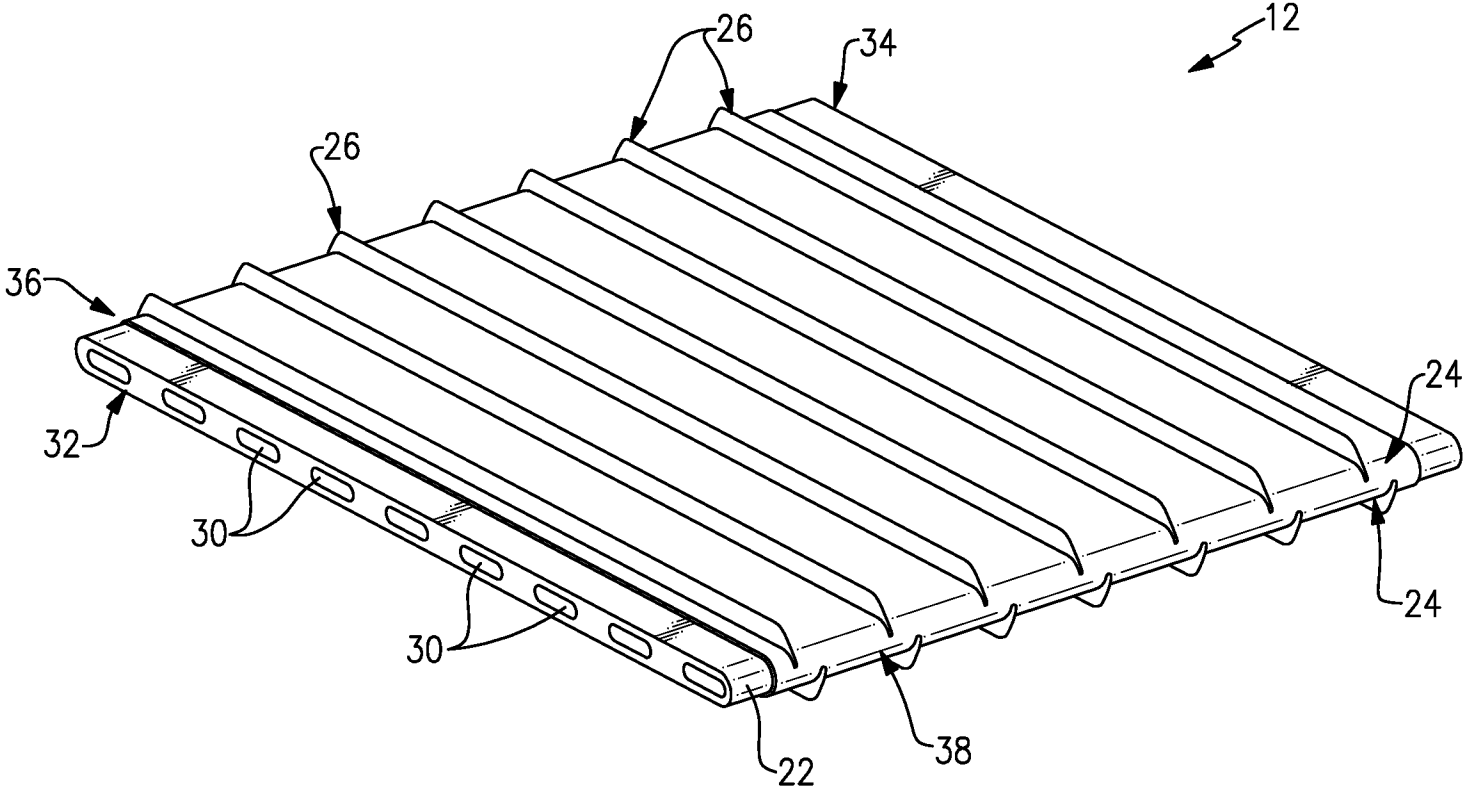
FIG. 2 is a perspective view of an example plate assembly.

Referring to FIG. 2 with continued reference to FIG. 1, one of the example plate assemblies 12 is shown and includes a primary plate 22 to which is attached secondary plates 24. In this example, a secondary plate 24 is attached to top and bottom surfaces of the primary plate 22.

The primary plate 22 includes a plurality of internal passages 30 that extend between an inlet side 32 and an outlet side 34. In this example, the inlet side 32 and outlet side 34 are identical to provide a symmetric primary plate 22.

Each of the secondary plates 24 are attached to the primary plate 22 and define a plurality of fin portions 26 and heat augmentation structures 28. The heat augmentation structures 28 condition flow between the fins 26 to enhance heat transfer. Moreover, in this example, the primary plate 22 is a one piece unitary cast structure to which the secondary plates 24 are attached.

Figure 3:
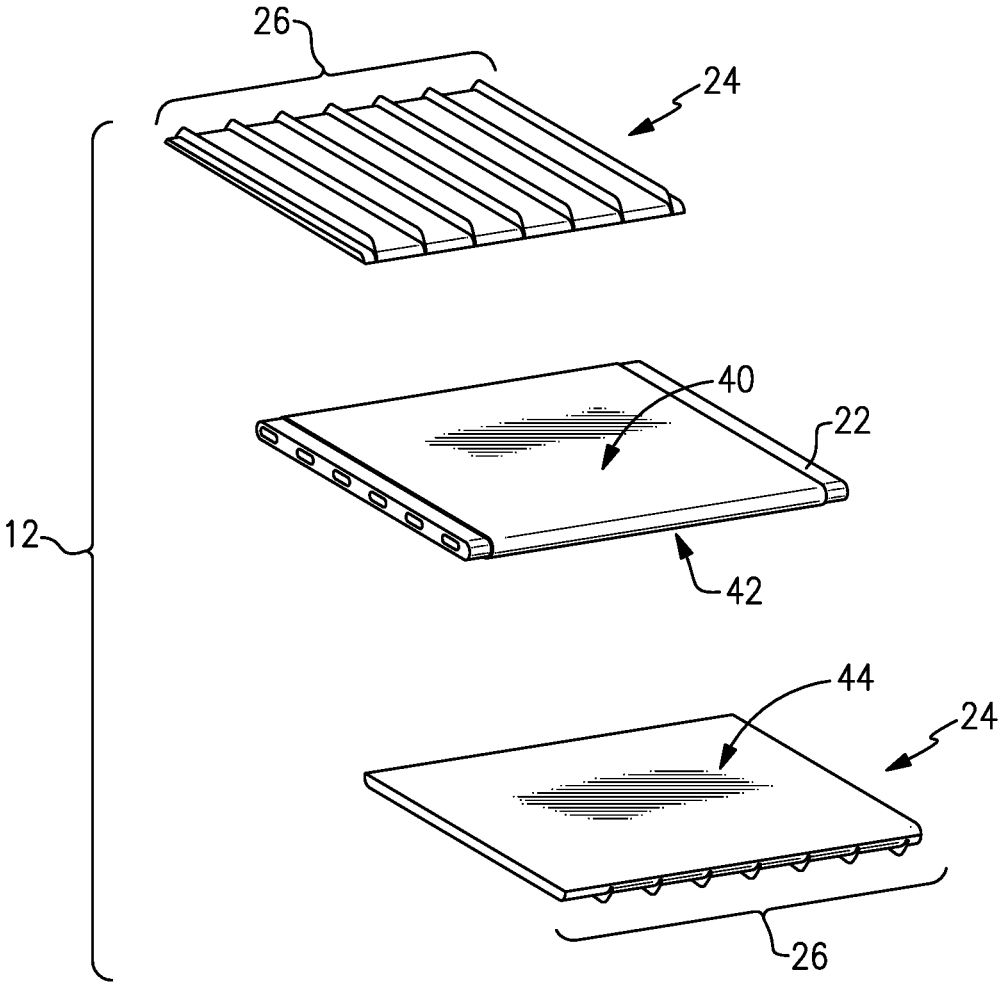
FIG. 3 is an exploded view of the example plate assembly.
Figure 4:
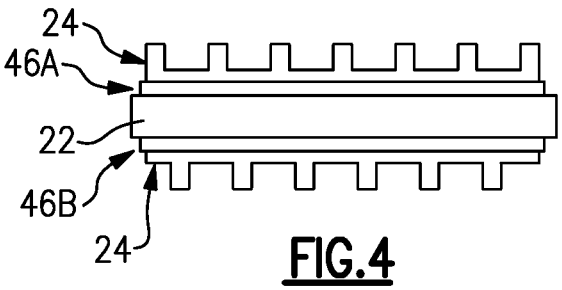
FIG. 4 is a cross-sectional view of the example plate assembly.

Referring to FIGS. 3 and 4 with continued reference to FIG. 2, the example plate assembly 12 is shown in exploded view with the secondary plates 24 removed from the primary plate 22. The primary plate 22 includes a first top surface 40 and a second bottom surface 42 that are smooth and provide for the joining and attachment of the secondary plates 24. It should be understood that top and bottom as used in this disclosure are not intended to be limiting, but are instead utilized to disclose relatively situated features.

The secondary plates 24 include the first side with the fins 26 and a flat joint side 44 that corresponds with the surfaces 40, 42 of the primary plate 22. The side 44 is planer and continuous to provide a uniform mating surface with the primary plate 22. In this example, the secondary plates 24 are joined to the surface 40 and the surface 42 of the primary plate 22 at joints 46*a*, 46*b*. The joints 46*a*, 46*b* comprise conventional brazed joints to provide a sufficient bond between the primary plate 22 and the secondary plate 24 while also enabling heat transfer between flow within the passages 30 of the primary plate 22 to the secondary plates 24. Other joining techniques between the secondary plates 24 and the primary plate 22 could also be used within the contemplation and scope of this disclosure, such as for example transient liquid or diffusion bonded joints.

Figure 5:
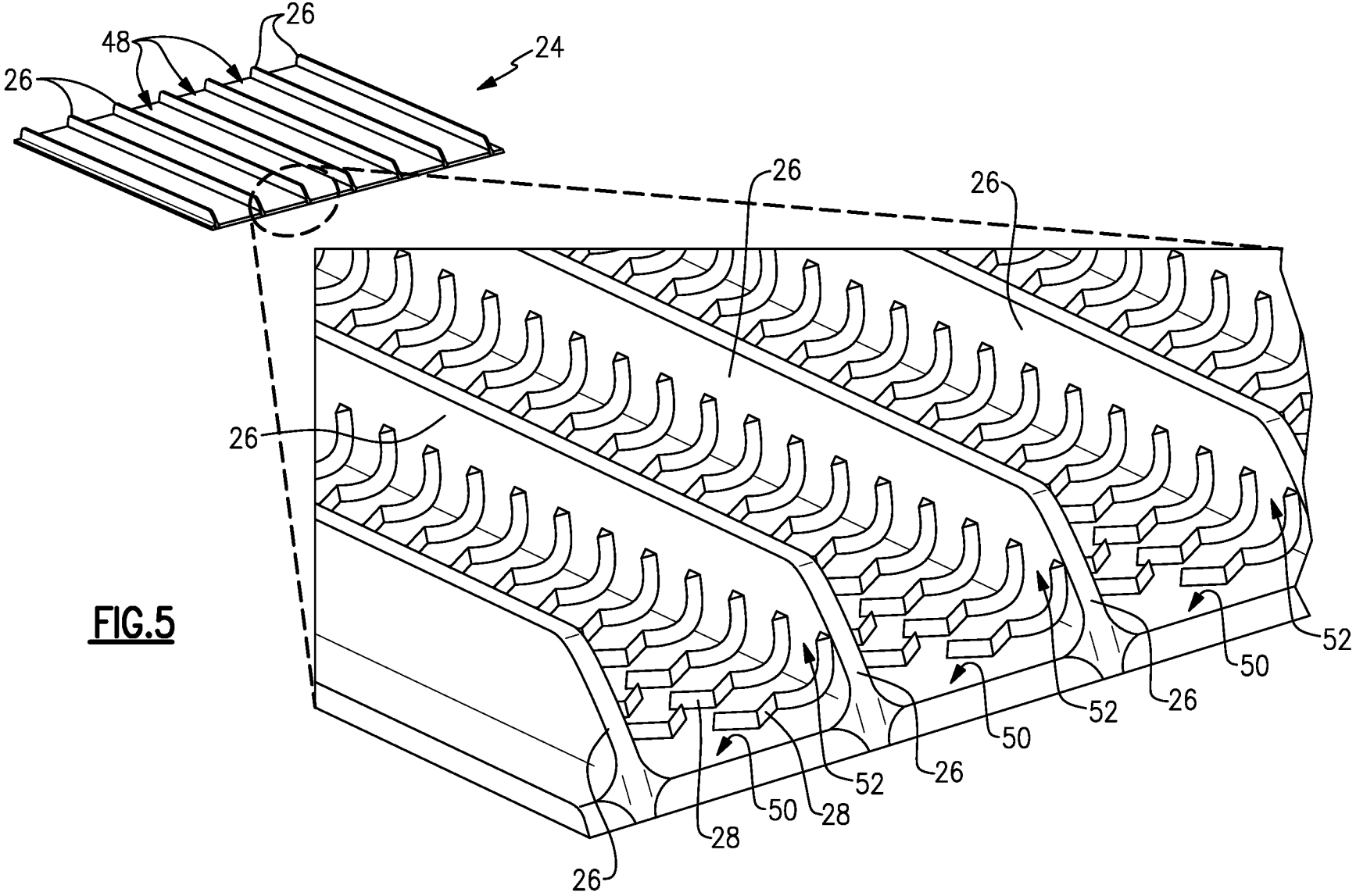
FIG. 5 is an enlarged view of a top surface of an example secondary plate

Referring to FIG. 5 with continued reference to FIG. 2, the example secondary plate 24 includes the plurality of fins 26 that define channels 48 for cooling air flow 20. Cooling air flow flows over the fins 26 and between fins 26 within the channels 48. The channels 48 include augmentation structures in the form of trip strips 28 that break up laminar flow and enhance transfer of thermal energy between the plate 24 and the cooling air flow 20. The augmentation structures 28 also condition the characteristics of air flow such as for example creation of swirl or directing flow into contact with surfaces of the secondary plate 24 that further enhance thermal transfer.

In this example, the trip strips 28 are arranged on the channel bottom 50 and extend up sides 52 of each of the fins 26. Forming of the trip strips 28 to extend from the channel bottom 50 up the sides 52 of the fins 26 is enabled in part by providing these features in the secondary plate 24 that is then attached to the primary plate 22. Moreover, the complex structures and features provided in the secondary plate 24 are enabled in part by forming the secondary plate 24 as a separate unit from the primary plate 22.

Figure 6:
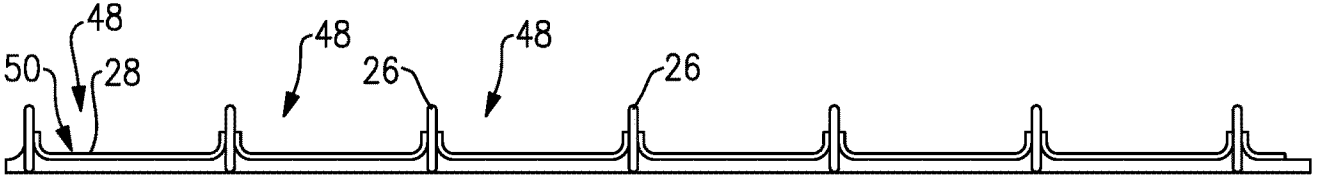
FIG. 6 is a side view of the example secondary plate.
Figure 7:
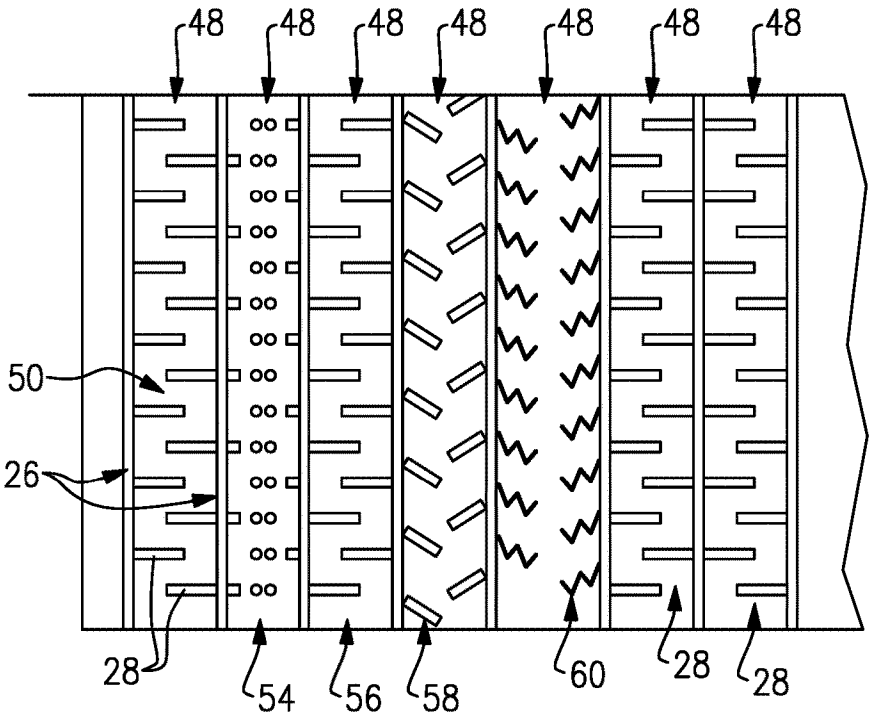
FIG. 7 is a top view of portions of the example secondary plate.

Referring to FIGS. 6 and 7, the example secondary plate 24 is shown and includes the plurality of channels 48 defined between the fins 26. In this example, each of the plurality of channels 48 is shown schematically and illustrate different heat augmentation structures and configurations that could be formed as part of the secondary plate 24 and that are within the contemplation of this disclosure. In each example, the heat augmentation structures are disposed both on the channel bottom 50 and sides 52 of the plurality of fins 26. It should further be understood, that although several example configurations for heat augmentation structures are disclosed, other structures, sizes, shapes and numbers of heat augmentation features could also be utilized and are within the contemplation of this disclosure.

In one example, the heat augmentation structures are pedestals as indicated at 54. In another example embodiment, the heat augmentation structures are depressions and/or groove as schematically shown at 56. The grooves 56 extends along the channel bottom 50 and up the sides 52 of at least some of the fins 26. Additionally, the heat augmentation structures could include a plurality of trip strips 58 angled either toward or away from the direction of cooling air flow. In this example the trip strips 58 are angled in a direction of cooling flow, but could also be angled toward the flow. In addition, another example the trip strip 60 includes a W-shape that extends into the channel 48 from both the channel bottom 50 and fin sides 52.

Accordingly, it should be understood that many different shapes, sizes, and orientations of heat augmentation structures are within the contemplation and scope of this disclosure. Other shapes, sizes, and density distribution of heat augmentation features can be provided within the plurality of channels 48 defined within the secondary plate 24.

The materials of the secondary plate 24 and the primary plate 22 can be of a common material to provide a common thermal and mechanical properties. Moreover, the secondary plate 24 may be constructed of a material different than the primary plate 22 to enable the use of materials with different thermal and mechanical properties for the primary plate 22 and the secondary plate 24 to enable advantageous use of different materials.

Figure 8:
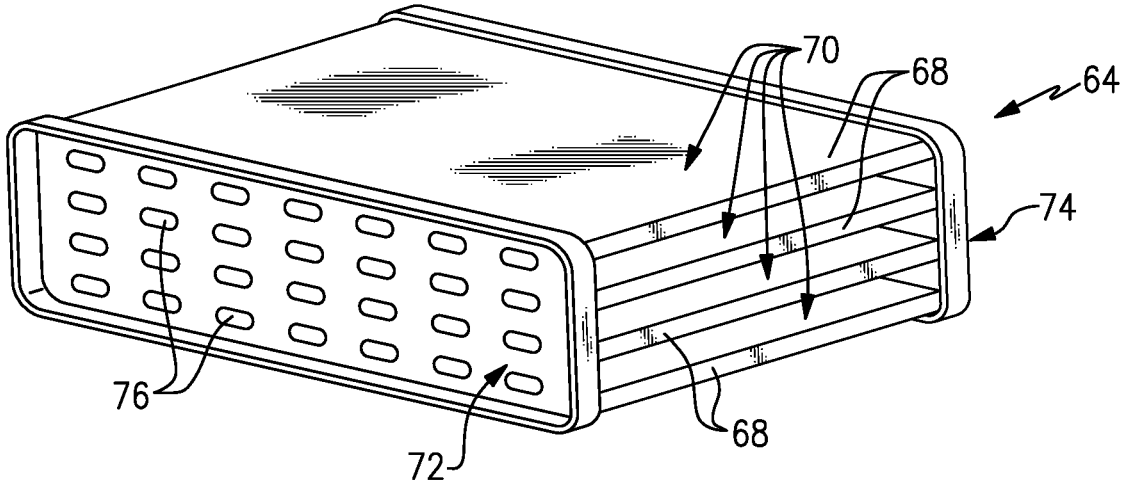
FIG. 8 is a perspective view of another example primary plate.
Figure 9:
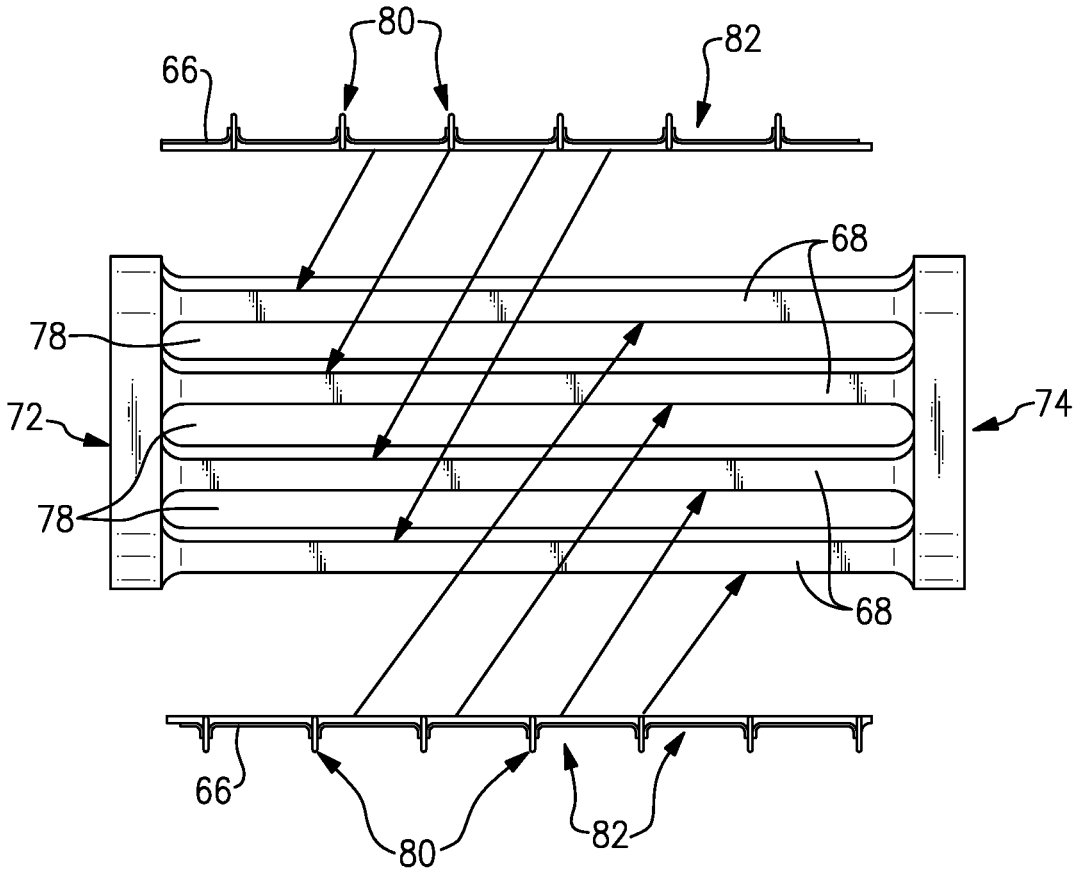
FIG. 9 is an exploded view of another example plate assembly.
Figure 10:
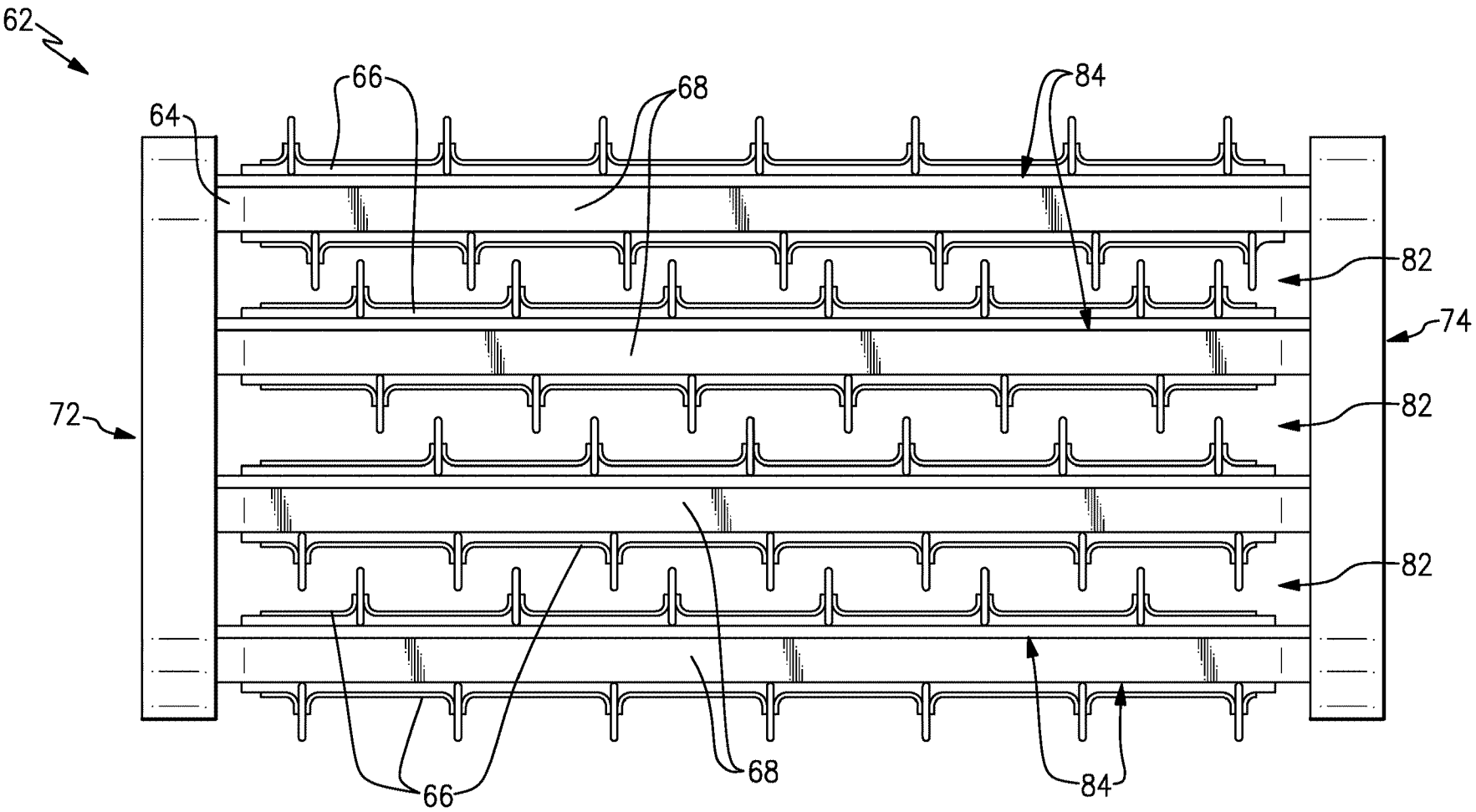
FIG. 10 is a side view of the example plate assembly.

Referring to FIGS. 8, 9 and 10, another plate assembly 62 (FIG. 10) includes a primary plate 64 schematically shown with a plurality of plate portions 68 formed as a single integrated unit with a common inlet face 72 and a common outlet face 74. The inlet face 72 and the outlet face 74 are substantially identical and can be interchanged depending on application specific requirements. Each of the plate portions 68 include a plurality of passages 76 that extend between the inlet 72 and the outlet 74. Moreover, each of the plate portions 68 include surfaces 70 that are flat to accept secondary plates indicated at 66.

Each of the secondary plates 66 are joined to surfaces defined in the primary plate assembly 64. Each of the plate portions 68 include flat surfaces 70 and both a top and a bottom side. Secondary plates 66 include a plurality of fins 80 bounding channels 82 that can include heat augmentation structures of any type or configuration previously disclosed. Spaces 78 between the plate portions 68 define cooling channels 78 with surfaces defined by the secondary plates 66 attached to surfaces of the primary plate 64.

The example plate assembly 62 includes the cooling channels 82 within a space 78 between the plate portions 68. The spaces 78 include the secondary plates 66 adhered to surfaces 70 of each of the plate portions 68. Accordingly, each of the cooling spaces 78 include secondary plates 66 that define fins 80 and heat augmentation structures 84 to enhance thermal transfer between the hot and cool flows.

Accordingly, the example plate assemblies include a multi-port construction that separates the cooling side heat transfer features from the passages defined for the hot air flow. Separation of the cool side features in the hot side features enable more complex heat augmentation structures that enable increased thermal transfer efficiencies.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A heat exchanger comprising:

a primary one-piece unitary cast plate including a first surface, a second surface, a leading edge, a trailing edge and a plurality of internal passages extending between an inlet and an outlet; and a secondary one-piece unitary cast plate that includes a flat joint side attached to at least one of the first surface and second surface of the primary plate, and a first side with heat transfer structures, wherein the heat transfer structures include a plurality of fin portions disposed between open channels, wherein the heat transfer structures of the secondary plate include augmentation structures; wherein the augmentation structures extend from the channel bottom up a side of at least one of the plurality of fin portions bordering the channel bottom.

2. The heat exchanger as recited in claim 1, wherein the augmentation structures comprise trip strips that alternate between extending up one of the plurality of fin portions on one side of the bottom channel and extending up another of the plurality of fin portions on another side of the bottom channel.

* * * * *